United States Patent [19]

Fabbri et al.

[11] 3,980,428

[45] Sept. 14, 1976

[54] DYEING PROCESS

[75] Inventors: Sergio Fabbri, Basel; Josef Frauenknecht, Therwil, both of Switzerland

[73] Assignee: Sandoz Ltd., Basel, Switzerland

[22] Filed: Oct. 31, 1973

[21] Appl. No.: 411,255

[30] Foreign Application Priority Data

Nov. 6, 1972 Switzerland ..... 16126/72
Jan. 30, 1973 Switzerland ..... 1332/73

[52] U.S. Cl. ..... 8/92; 8/93; 8/173; 8/177 AB

[51] Int. Cl.[2] ..... D06P 1/41; D06P 1/64; D06P 1/653

[58] Field of Search ..... 8/92, 93, 173, 177 AB

[56] References Cited

UNITED STATES PATENTS

| | | | |
|---|---|---|---|
| 2,950,949 | 8/1960 | Schlack | 8/173 |
| 3,346,322 | 10/1967 | Finkenauer | 8/93 |
| 3,909,192 | 9/1975 | Gertisser | 8/90 |

FOREIGN PATENTS OR APPLICATIONS

| | | |
|---|---|---|
| 1,073,681 | 9/1954 | France |
| 1,022,549 | 7/1958 | Germany |

OTHER PUBLICATIONS

Hannay et al., Jour. Soc. Dyers and Colorists, June 1953, pp. 195–201.

*Primary Examiner*—H.S. Cockeram
*Attorney, Agent, or Firm*—Gerald D. Sharkin; Richard E. Vila; Thomas C. Doyle

[57] ABSTRACT

The present invention relates to a process for dyeing or printing organic substrates in the presence of lactone, the amount of which is sufficient to adjust the pH value of the dyeing or printing medium from a neutral or basic value to a value from 4.0 to 6.5.

18 Claims, No Drawings

DYEING PROCESS

The present invention relates to a process for dyeing or printing organic substrates.

Accordingly, the present invention provides a process for dyeing or printing natural or synthetic organic substrates comprising dyeing or printing with a dyeing or printing medium in the presence of between 0.1 to 1 part per thousand, based on the dyeing or printing medium, of a lactone to adjust the pH value from a neutral or basic to a value from 4.0 to 6.5.

The lactones employed in the dyeing or printing process of the invention are hydrolysed in situ under the basic or natural conditions to liberate the corresponding acid, thus decreasing the pH value. The amount of lactone is preferably such as to adjust the pH value to a value from 5 to 6.

The lactones employed may be derived from aliphatic hydroxycarboxylic acids.

Thus, the lactones employed are of the formula I

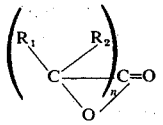

I in which each of $R_1$ and $R_2$, which may be the same or different, signifies a hydrogen atom or an alkyl radical of 1 to 8 carbon atoms, and n is 1, 2, 3 or 4.

As examples of suitable lactones may be given for example, the internal condensation products of $\alpha$-hydroxycarboxylic acids, e.g. of glycolic acid, lactic acid or $\alpha$-hydroxybutyric acid; lactones of $\beta$-hydroxycarboxylic acids e.g. $\beta$-propiolactone; lactones of $\gamma$-hydroxycarboxylic acids e.g. $\gamma$-butyrolactone, $\gamma$-valerolactone; lactone of $\gamma$-hydroxy derivatives of caproic, heptylic, caprylic or pelargonic acid or lactones of $\Delta$-hydroxy-carboxylic acids. Preferably $\gamma$-butyrolactone is employed.

According to one aspect of the invention dyeing or printing begins at a basic pH value e.g. 7.5 to 11, preferably from 8 to 9, which pH value may be obtained by the addition of a basifier.

This is of importance in cases where the dye would be taken up too rapidly by the substrate in an acidic or neutral medium, especially at high temperatures, e.g. boiling temperatures, resulting in an uneven dyeing. Thus, in such cases a basifier is added and dyeing is carried out for a short time in a basic medium and the lactone is added subsequently to exhaust the dye liquor.

Furthermore, according to another aspect, a basifier and a lactone are added to the dyeing or printing medium simultaneously, so that a precise adjustment of the pH can be obtained and such a pH value maintained. This is especially important in dyeing differential polyamides.

Suitable basifiers which may be employed to obtain the basic pH value include alkali hydroxides such as, sodium or potassium hydroxide; alkali borates such as borax; basic reactive alkali salts of organic acids such as sodium or potassium formate, acetate, propionate and/or butyrate; alkali salts of valeric acid, caproic acid, heptylic acid, caprylic acid, pelargonic acid, capric acid, lauric acid, myristic acid, palmitic acid, stearic acid, behenic acid, glycollic acid, lactic acid, methoxy acetic acid, oxalic acid, malonic acid, succinic or glutaric acid. Preferably, an alkali salt of a lower fatty acid is employed, in particular sodium or potassium acetate.

If only hard water is available for dyeing, water softeners which also act as basifiers may be employed. As examples of such substances, may be given tetrasodium ethylene diamino tetracetate or trisodiumnitrilotriacetate.

As will be appreciated the level to which the pH is adjusted, and hence the relative amount of lactone employed, depends on the type of dye employed and on the required depth of shade. The quality of the water and the dye mixture may also influence the pH value of the dye liquor. Thus, the necessary quantity of basifier to lactone may vary in each case. The ratio, by weight, of basifier to lactone may vary e.g. within the range of from 1:50 to 50:1, preferably from 1:4 to 4:1 and particularly from 1:1,5 to 1.5:1. A suitable operating ratio is 1:1.

The substrate may be prewashed with ammonia or another base, in such cases no basifier need be added.

As examples of suitable organic substrates may be given, natural and synthetic polyamides, such as wool, silk, the polymer products of $\epsilon$-caprolactam condensation products of dicarboxylic acid, e.g. adipic acid and polymethylene diamines such as hexamethylene diamine (nylon 6, nylon 66, nylon 610 etc.); acid dyeable polyesters; cellulose-2½-acetate; cellulose triacetate; polypropylene; polyacrylonitrile; basic modified polyacrylonitrile and blends of the foregoing.

The substrate may be in fibre, fabric or yarn form, preferably in fabric form, such as fleeces and carpets, e.g. tufted or needle felt carpets.

The dyeing process according to the invention may be carried out at a temperature range of from 20° to 160°. Thus, the process may be carried out at low temperatures; e.g. cold dyeing process e.g. 20° to 50°C, at increased temperatures e.g. 50° to 100°C, preferably 80° to 100°C or at elevated temperatures under pressure e.g. up to 160°C, preferably in the range from 100° to 140°C as can be done in HT-type beam dyeing machines.

According to one particular embodiment the dye may be dissolved with auxiliary agent e.g. a surfactant, and, as the case may be, a basifier, so that the pH value is adjusted to a value of from 7.5 to 11, preferably from 8 to 9 preferably in hot water. The substrate to be dyed may already be contained in the hot water dye bath or may be entered at this stage. The fabric is preferably dyed for 10 to 20 minutes at the alkaline pH value. The lactone, preferably dissolved in cold water, is then added over a period of 10 to 20 minutes. Then dyeing at the boil is carried out for a further 20 to 40 minutes.

Alternatively, the auxiliary agent and the lactone may be simultaneously entered into the bath containing the substrate to be dyed, in which case the temperature of the bath is preferably in the range of from 50° to 90°C, more preferably 70° to 85°C. Thus, if necessary dyeing at 80°C is carried out from 10 to 20 minutes. Then the bath is raised to the boil over a period of from 10 to 20 minutes. This temperature is maintained for 40 to 60 minutes, after which dyeing is completed.

Still further, the dye bath which may already contain the substrate to be dyed is prepared at a temperature from 20° to 30°C. The dye, the auxiliary agent, the lactone and, as the case may be, basifier, are added. The temperature of the bath is raised to the boil over a period of up to 30 minutes and the substrate is dyed at this temperature for about 1 hour. As the hydrolysis of the lactone progresses the pH value drops to 4 to 6.5 preferably 5 to 6 and subsequently remains constant. This constant pH value is of importance if a particular shade is desired. An acid may be added towards the end of the dyeing process without harmful effect.

Still further, fabrics may be impregnated with dye liquors or printing pastes according to continuous or space dyeing methods or according to known printing processes, the take up and fixation of the dye may be effected with the lactone alone in saturated stream at 100°C, in superheated steam or in dry heat at 120° to 220°C preferably, 140° to 160°C, or in combination with a basifier.

A cold dyeing process may be employed for dyeing substrates susceptible to deformation e.g. natural or synthetic polyamides. At temperatures of from 20° to 60°C fixation may take from 6 to 48 hours, preferably the process is carried out at temperature between 20° to 40°C. This process is employed advantageously with flat fabrics, e.g. cut pile carpets which undergo deformation of the pile when conventionally dyed in boiling liquor. The process is effected by pouring the dye liquor, containing the lactone and a small quantity of thickening agent, over the fabric at room temperature. The quantity of thickening agent is chosen so as to allow an even distribution of the dye liquor on the fabric. Chemical agents with a high wetting power ability to improve liquor transfer within the flat fabric and the entire substrate block by forming a very fine microfoam may also be added. Suitable foaming agents are described in Belgian Pat. No. 772,950. Preferably, the quantity of dye liquor is limited to that amount at which the substrate contains only as much liquor as it can carry, precluding any losses through draining. Thus, the dye liquor amounts to 260–800% 400–600% of the weight of the substrate. Preferably low molecular weight dyes are employed and contain only one sulphonic group, and during fixation at room temperature the rolled up substrate is kept in continuous rotation.

The process according to the invention is particularly suitable for dyeing with acid dyes or mixtures of acid dyes with metal complex dyes, disperse dyes, reactive dyes, or basic dyes as are described for example, in H. R. Schweizer, Kunstliche Organische Farbstoffe. Volume I, Verlag VCS, 1959.

The process according to the invention facilitates a precise pH value to be obtained which is of particular importance, e.g. when differential polyamides are to be dyed, e.g. polyamides containing a regular, a low, a deep and a non-acid dyeable but base dyeable component. Such a mixture necessitates the presence of both acid and basic dyes in the dye bath, this requires a pH value of from 5.5 to 6 which can be obtained by the process of the present invention.

The following Examples serve to further illustrate the invention. In the Examples, and elsewhere in the specification, all parts and percentages are by weight and all temperatures are in degrees centigrade. A list of auxiliary agents A–G employed in the Examples is given after Example 29.

In Examples 1 to 5 washing and dyeing in a single bath are described. The substrate is pre-washed with ammonia and a detergent.

EXAMPLE 1

In a winch-beck containing 900 parts soft water, 30 parts "Helanca" tubular goods are pre-washed with the following additions:

0.45 parts concentrated ammonia
0.9 parts auxiliary agent A (see list following Examples)

After washing in the conventional way at 80°C for 10 minutes, the following additions are entered in the alkaline liquor, the temperature being maintained at 80°C:

0.03 % C.I. dye Constitution no. 23 260
0.15 % C.I. dye Constitution no. 18 134
0.01 % C.I. dye Constitution no. 13 390
2 % auxiliary agent B (see list following the Examples)

The dyeing bath is raised to the boil and maintained at that temperature for 10–20 minutes. Subsequently, 0.54 parts γ-butyrolactone (acidifier) dissolved in about 100 parts cold water are added over a period of 10 minutes and the dyeing continued for another 40–60 minutes at the boil. On completion of the dyeing procedure the pH value is 5.5.

EXAMPLE 2

The procedure of Example 1 is followed, but with the following dyes and auxiliary agents:

0.06 % C.I. dye Constitution no. 20 195
0.01 % C.I. dye Constitution no. 45 100
0.003 % C.I. dye Constitution no. 62 045
2 % auxiliary agent C (see list)

On completion of the dyeing procedure the pH value is 5.6.

EXAMPLE 3

The procedure of Example 1 is followed, the following products being employed for washing:

0.45 parts concentrated ammonia
4 % auxiliary agent C (see list)

In the dyeing processes the following dyes are employed:

0.1 % C.I. dye Constitution no. 18 835
0.6 % C.I. dye Constitution no. 20 195

On completion of the dyeing procedure the pH value is 5.7.

EXAMPLE 4

The procedure of Example 1 is followed, the following products being employed for washing:

0.45 parts concentrated ammonia
4 % auxiliary agent C (see list)

In the dyeing process 0.2 % C.I. dye Constitution no. 18 850

On completion of the dyeing procedure the pH value is 5.7.

EXAMPLE 5

In a winch beck containing 900 parts soft water, 30 parts "Helanca" tubular goods are pre-washed at 80°C for 10 minutes with 0.9 parts concentrated ammonia
4 % auxiliary agent C (see list)

The temperature of the bath being maintained at 80°C.

0.1 % C.I. dye Constitution no. 26 370 and
4 % auxiliary agent B (see list)

are entered and the bath is raised to the boil. This temperature is maintained for 40 minutes after which, 0.9 parts γ-butyrolactone dissolved in 100 parts cold water are added over a period of 10 minutes and the dyeing continued for another 10–30 minutes at 95°–100°C. On completion of the dyeing procedure the pH value is 6.7.

In the following Examples 6–10 a short duration dyeing procedure for polyamide piece goods is described. Even at boiling temperatures anionic and metal complex dyes build up slowly on polyamides in alkaline medium. The dyes are entered together with a basifier (borax or sodium acetate) in the boiling liquor. Subsequently, the lactone is added, causing the pH value to drop gradually and the liquors, to be exhausted.

By employing hot or boiling water, heating-up periods are considerably reduced or are eliminated altogether which results in noticeable time saving.

EXAMPLE 6

In a winch beck containing 900 parts boiling soft water in which 0.45 parts borax (alkalifier) are dissolved, 30 parts "Helenca" tubular goods 0.2 % C.I. dye Constitution no. 23 260
0.1 % C.I. dye Constitution no. 13 390 and
2 % auxiliary agent B (see list), all dissolved in hot water, are entered.

After 10 minutes, 0.63 parts γ-butyrolactone (acidifier), dissolved 100 parts cold water, are added over a period of 10 minutes and the dyeing is continued for 40–60 minutes at 95°–100°C. On completion of the dyeing procedure the pH value is 5.6.

EXAMPLE 7

The procedure of Example 6 is followed, but with 0.45 parts anhydrous sodium acetate as basifier and 0.09 parts gluconic acid delta-lactone as acidifier.

On completion of the dyeing procedure the pH value is 6.1.

EXAMPLE 8

The procedure of Example 6 is followed, but with 0.09 parts anhydrous sodium acetate as basifier and 0.36 parts γ-butyrolactone as acidifier. The following dye is employed:

0.13 % C.I. dye Constitution no. 18 155.

On completion of the dyeing procedure the pH value is 6.0.

EXAMPLE 9

The procedure of Example 6 is followed, but with 0.09 parts anhydrous sodium acetate as basifier and 0.45 parts β-propiolactone as acidifier.

On completion of the dyeing procedure the pH value is 4.1.

EXAMPLE 10

The procedure of Example 6 is followed, but with 0.09 parts anhydrous acetate as basifier and 0.45 parts Δ-valerolactone as acidifier.

On completion of the dyeing procedure the pH value is 5.8.

In the following Examples 11–17 a short-duration dyeing process for polyamide carpet pieces in winch becks is described. Usually, dyeing of polyamide carpet pieces which as a rule are 4–5 meters wide and up to 200 meters long, takes 2–3 hours. A considerable portion of this time is due to the heating-up period taking about 1.5 hours. The dye liquor must be heated up slowly because otherwise the dyeing of surfaces of this size is liable to result in deficient levelness. As, however, anionic dyes, particularly those conventionally employed in the dyeing of carpets, are greatly retarded in alkaline medium, even at boiling temperature, dyeing may be commenced at temperatures of 80°C and higher as soon as a basifier is present.

If necessary, dyeing may also be commenced at room temperature, heating-up time for the dye liquor depending on the thermal equipment of the dyeing machine employed. In order to exhaust the liquor an acidifier is added according to the invention. This procedure permits considerable saving of time.

EXAMPLE 11

In a carpet winch beck containing 1800 parts boiling water in which 0.18 parts anhydrous sodium acetate are dissolved, 55 parts loop pile carpet of non-dye, low-dye, regular and deep-dye polyamide yarns are present, the reverse side of the carpet being of propathene. The following products are entered into the boiling liquor:

0.1 % C.I. dye Constitution no. 62 015
0.3 % C.I. dye Constitution no. 20 195
0.3 % C.I. dye Constitution no. 45 100
0.015 % C.I. dye Constitution no. 61 585
0.01 % C.I. dye Constitution no. 50 240
0.06 % C.I. dye Constitution no. 51 004
2 % auxiliary agent B (see list).

The dyeing time is 10 minutes, the temperature being maintained at 95°–100°C. 1,08 Parts γ-butyrolactone dissolved in 100 parts cold water added over a period of 10 minutes and the dyeing is continued for another 40–60 minutes at boiling temperature. The operation cycle is completed in the conventional way, the pH value is 5.9.

EXAMPLE 12

In a carpet winch beck containing 1800 parts boiling soft water in which 0.18 parts borax are dissolved 55 parts loop pile carpet of regular and non-dye polyamides with propathene reverse side are present. The following products are entered in the boiling liquor:

0.12 % C.I. Constitution no. 19 130
0.2 % C.I. dye Constitution no. 10 385
0.13 % C.I. dye Constitution no. 51 004
2 % auxiliary agent B (see list).

After 10 minutes 0.18 parts γ-butyrolactone dissolved in 100 parts cold water are added to the dye bath over a period of 10 minutes and the dyeing is completed after another 40–60 minutes at the boil.

On completion of the procedure the pH value is 5.9.

EXAMPLE 13

The procedure of Example 12 is followed, but the dyeing is not carried out in soft water but in hard water of 10° German hardness in which 1.8 parts tetrasodium ethylene diamino tetraacetate are dissolved. 1.6 parts γ-butyrolacetone are employed as acidifier. On completion of the procedure the pH value is 5.9.

EXAMPLE 14

In a carpet winch beck containing 1800 parts soft water at 80°C in which 0.18 parts anhydrous sodium acetate are dissolved, 55 parts loop pile carpet of low-dye, regular and deep-dye polyamide yarns with jute reverse side are present.

The dye liquor is set with the following products at 80°C:

0.2 % C.I. dye Constitution no. 20 195
0.015 % C.I. dye Constitution no. 45 100
0.3 % C.I. dye Constitution no. 62 045
1 % auxiliary agent C (see list).

The bath is raised to the boil and maintained at that temperature for 10 minutes. 1.8 parts γ-butyrolactone dissolved in 100 parts cold water are added over a period of 10 minutes. After another 40–60 minutes at the boil dyeing is completed. On completion of the procedure the pH value is 5.6.

EXAMPLE 15

The procedure of Example 14 is followed, but the dye liquor is set with the following products at 80°C:

0.05 % C.I. dye Constitution no. 23 260
0.04 % C.I. dye Constitution no. 18 134
0.06 % C.I. dye Constitution no. 13 390
1 % auxiliary agent B } (see list)
1 % auxiliary agent C }

On completion of the procedure the pH value is 5.6.

EXAMPLE 16

A carpet winch beck contains 55 parts carpeting as in Example 14 and 1800 parts soft water at 20°C. The following products are entered in the liquor at room temperature:

0.18 parts anhydrous sodium acetate
0.15 % C.I. dye Constitution no. 18 850
0.17 % C.I. dye Constitution no. 10 385
0.16 % C.I. dye Constitution no. 44 045
2 % auxiliary agent B (see list).

The dye liquor is raised to the boil as quickly as possible. Subsequently, 1.8 parts γ-butyrolactone dissolved in 100 parts cold water are added over a period of 10 minutes and the dyeing is completed after another 40–60 minutes at 95°–100°C. On completion of the procedure the pH value is 5.7.

EXAMPLE 17

A carpet winch beck contains 1800 parts soft water at 80°C and 55 parts loop pile carpet of non-dye, regular, low-dye and deep-dye polyamide yarns with jute reverse side. The dyeliquor is set with the following products at 80°C:

0.08 % C.I. dye Constitution no. 11 005
0.08 % C.I. dye Constitution no. 11 855
0.2 % C.I. dye Constitution no. 20 195
0.04 % C.I. dye Constitution no. 45 100
0.04 % C.I. dye Constitution no. 62 045
2 % auxiliary agent B (see list)

After 10 minutes, still at 80°C, 1.8 parts γ-butyrolactone dissolved in 100 parts water are entered into the bath over a period of 10 minutes. The dyeing is completed after another 40–60 minutes at 80°C.

On completion of the procedure the pH value is 6.0.

In Examples 18 and 19 continuous dyeing of polyamide carpets is described. Polyamide carpet piece goods may be dyed continuously on suitable machines.

EXAMPLE 18

Using a suitable appliance, 400 parts of a dyeliquor of the following composition are poured over 100 parts polyamide 6 loop pile carpet with propathene reverse side:

0.15 parts C.I. dye Constitution no. 20 195
0.15 parts C.I. dye Constitution no. 62 045
0.55 parts C.I. dye Constitution no. 18 850
4 parts locust bean flour (Indalca PA 1)
3.5 parts nonylphenol polyglycol ether
0.4 parts butyrolactone.

The carpet is subsequently conveyed through a continuous steamer where the dyes are fixed in saturated steam at 100°C for 10 minutes.

EXAMPLE 19

The procedure of Example 18 is followed, but with a carpet as described in Example 11.

The dyeliquor is of the following composition:

0.15 parts C.I. dye Constitution no. 20 195
0.15 parts C.I. dye Constitution no. 62 045
0.55 parts C.I. dye Constitution no. 18 850
0.09 parts C.I. dye Constitution no. 44 045
0.05 parts C.I. dye Constitution no. 48 035
4 parts locust bean flour (Indalca PA 1)
2 parts nonylphenyl polyglycol ether
2 parts auxiliary agent B (see list)
0.4 parts gluconic acid Δ-lactone.

In Examples 20–22 dyeings of differential polyamides and of polyamides reserved with a colourless fibre-reactive compound are described. The dyeing of polyamides which are reserved with a colourless fibre-reactive compound as well as that of differential polyamides requires the pH value of the liquor to remain constant. If, for example, anionic and cationic dyes are employed simultaneously, the pH value of the liquor must be between 5 and 6 in order to obtain pure colours. As a rule, the dyeliquor is buffered at the required pH value with phosphates. Since a constant final pH value is also obtained when a basifier and an acidifier, such as sodium acetate and butyrolactone, are employed phosphates may thus be replaced.

EXAMPLE 20

30 parts "Helanca 66" which is one third reserved with a compound of formula

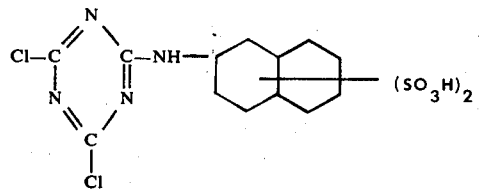

are dyed in 900 parts soft water. The dyeliquor is set with the following products:

0.45 parts anhydrous sodium acetate
0.27 parts γ-butyrolactone
0.16 % C.I. dye Constitution no. 13 390
0.06 % C.I. dye Constitution no. 48 035
2 % auxiliary agent B (see list).

The dyeliquor is gradually raised to the boil. Dyeing is completed after 1 hour at the same temperature in the conventional way. On completion of the procedure the pH value is 5.8.

EXAMPLE 21

30 Parts knit fabric of differential polyamide (acid/-basic dyeable) are dyed in 900 parts soft water. The dyeliquor is prepared at room temperature with the following products:

0.45 parts anhydrous sodium acetate
0.27 parts butyrolactone
0.1 % C.I. dye Constitution no. 23 260
0.33 % C.I. dye Constitution no. 22 310
0.02 % C.I. dye Constitution no. 48 035
0.05 % C.I. dye Constitution no. 50 240
2 % auxiliary agent B (see list).

The substrate is mechanically agitated and the temperature of the dye bath gradually raised to the boil. The dyeing is continued for another hour and then completed in the conventional way.

On completion of the dyeing procedure the pH value is 5.8.

EXAMPLE 22

The procedure of Example 21 is followed, but with a dyeliquor of the following compositon:

0.45 parts anhydrous sodium acetate
0.27 parts butyrolactone
0.15 % C.I. dye Constitution no. 20 195
0.1 % C.I. dye Constitution no. 18 155
0.03 % C.I. dye Constitution no. 44 045
2 % auxiliary agent B (see list).

On completion of the procedure the pH value is 5.7.

In Examples 23–29 continuous dyeing of polyamide piece goods is described. Woven and knit polyamide fabrics may be dyed continuously. The dyeliquor is padded on by means of a padding machine and the dyes are subsequently fixed either in a steam atmosphere or by being maintained at room temperature. Steam fixation is carried out in a saturated steam at 100°C for from 10 minutes up to 2 hours. If the fabric is kept at room temperature, fixation will take between 3 and 48 hours. As a rule, dyeliquors conveniently employed in this process contained either free acids or phosphates. Both may now be replaced by butyrolactone, as is illustrated by this Example.

EXAMPLE 23

100 Parts polyamide piece goods are padded with 100 parts of a dyeliquor containing:

2 parts C.I. dye Constitution no. 20 195
0.4 parts C.I. dye Constitution no. 45 100
1.2 parts C.I. dye Constitution no. 62 045
10 parts locust bean flour
0.1 parts butyrolactone The goods thus impregnated are then fixed in a saturated steam at 100°C and rinsed.

EXAMPLE 24

The procedure of Example 22 is followed, but instead of butyrolactone 0.1 part of gluconic acid Δ-lactone is employed.

Exhaust dyeing of yarns

EXAMPLE 25

In a suitable vessel 30 parts polyamide 6 yarn are dyed in 100 parts of soft water with addition at room temperature of the following products:

0.06 % C.I. dye Constitution no. 18 850
0.05 % C.I. dye Constitution no. 45 100
0.07 % C.I. dye Constitution no. 62 045
2 % auxiliary agent C (see list)
0.2 parts anhydrous sodium acetate
0.4 parts butyrolactone.

The dyeliquor is gradually raised to the boil and maintained at this temperature for 1 hour. On completion of the dyeing procedure the pH value is 5.8.

EXAMPLE 26

The procedure of Example 25 is followed, but with 30 parts wool yarn and a dyeliquor of the following composition:

0.15 % C.I. dye Constitution no. 19 020
0.06 % C.I. dye Constitution no. 18 134
0.03 % C.I. dye Constitution no. 23 260
1 % auxiliary agent D (see list)
0.1 parts anhydrous sodium acetate
0.06 parts butyrolactone.

On completion of the dyeing procedure the pH value is 6.0.

Rapid dyeing of finished and semi-finished products, stockings, stocking tights or socks.

EXAMPLE 27

A Multi Rapid rotary dyeing machine (of Passat - Textile Maschinenbau, W. Germany) is loaded with 200 parts polyamide socks and the drum rotated at 8 revolutions per minute. 2000 parts soft water at 80°C containing 1 part ammonia
2 % auxiliary agent B (see list)
1.5 % C.I. dye Constitution no. 26 360 are fed into the drum from the supplementary container. The dyeliquor is raised to 98°C in 4 minutes. On reaching the boiling temperature 1.4 parts butyrolactone dissolved in 50 parts cold water are added over a period of 2 minutes and dyeing is continued for 15 minutes at 98°C. After this time the pH value of the dyeliquor is 5.9. The liquor is cooled to 70°C in 5 minutes and subsequently extracted off the dyed goods by increasing rotation of the drum to 800 revolutions per minute. 2000 Parts fresh cold water are fed into the drum for rinsing and are then extracted after 3 minutes. Finally, the humid dyed goods are dried in a tumbler.

EXAMPLE 28

A Milnor dyeing machine (rotary dyeing machine of Pellerin - Milnor Corp. La. USA) is loaded with 150 parts polyamide stocking tights, loosely packed in 10 propathene net bags. The drum is rotated at 12 revolutions per minute. 1500 Parts soft water at 90°C containing 1 part anhydrous sodium acetate
2 % auxiliary agent F (see list)
0.45% C.I. dye Constitution no. 10 385
0.05% C.I. dye Constitution no. 62 125 are added from the supplementary tank. The liquor is raised to the boil in 3 minutes.

1.5 parts butyrolactone dissolved in 50 parts cold water are entered in the liquor. The dyeing is continued for 12 minutes after which the liquor is exhausted. The liquor is cooled to 75°C and extracted through the drain valve by increasing drum rotation. The dye substrate is rinsed for 5 minutes with 1500 parts fresh cold water which are fed into the machine.

Cold dyeing process for natural and synthetic polyamide fibre pile and flat textiles suspectible to deformation.

EXAMPLE 29

500 Parts dyeliquor of the following composition are poured over 100 parts polyamide cut pile carpet with propathene reverse side at room temperature:

8 parts C.I. dye Constitution no. 26 900
2 parts C.I. dye Constitution no. 62 055
25 parts auxiliary agent G (see list)
5 parts thickening on the basis of locust bean flour
0.5 parts gluconic acid Δ-lactone.

Subsequently, the substrate is wound onto a rotating roll and wrapped in a plastic cover so that no water may evaporate. It is thus fixed for 8 hours at room temperature.

List of auxiliary agents employed in the Examples

Auxiliary agent A: carboxymethylated nonylhexaglycolether
Auxiliary agent B: aminopropylaminopoly(90)-glycolether
Auxiliary agent C: octyl-diphenylether sodium disulphonate
Auxiliary agent D: carboxymethylated octylphenylpolyglycol ether
Auxiliary agent E: alkylphenyl pentaglycol ether
Auxiliary agent F: sulphonated diphenyl ether
Auxiliary agent G: lauryl alcohol glycolether sulphate

What is claimed is:

1. A process which comprises dyeing or printing a natural or synthetic organic substance with a dyeing or printing medium comprising a member selected from the group consisting of acid dyes and mixtures of acid dyes with metal complex, disperse, reactive or basic dyes to which has been added between 0.1 and 1 part per thousand, based on the dyeing or printing medium, of a lactone derived from an aliphatic hydroxy carboxylic acid to adjust the pH from a neutral or basic value to a value from 4.0 to 6.5.

2. A process according to claim 1, in which the lactone is the internal condensation product of an α-hydroxy-, β-hydroxy-, γ-hydroxy or δ-hydroxy carboxylic acid.

3. A process according to claim 1, in which the lactone is of formula I,

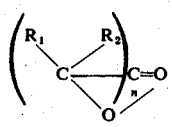

I in which each of $R_1$ and $R_2$, which may be the same or different, signifies a hydrogen atom or an alkyl radical of 1 to 8 carbon atoms, and n is 1, 2, 3 and 4.

4. A process according to claim 3, in which the lactone is derived from glycolic acid, lactic acid, γ-hydroxybutyric acid, β-hydroxypropionic acid, γ-hydroxybutyric acid, γ-hydroxyvaleric acid or γ-hydroxy derivatives of caproic, heptylic, caprylic or pelargonic acid.

5. A process according to claim 4, in which the lactone is γ-butyrolactone.

6. A process according to claim 1, in which the amount of lactone added to the dyeing or printing medium is from 0.5 to 0.7 parts per thousand based on the dyeing or printing medium.

7. A process according to claim 1, in which the lactone is added to a basic dyeing medium which basic dyeing medium has a pH value of from 7.5 to 11 and contains a basifier.

8. A process according to claim 1, in which the lactone is added to the dyeing or printing medium simultaneously with a basifier.

9. A process according to claim 7, in which the ratio of basifier to lactone is within the range of from 1:4 to 4:1.

10. A process according to claim 9, in which the ratio of basifier to lactone is 1:1.

11. A process according to claim 8, in which the ratio of basifier to lactone is within the range of from 1:4 to 4:1.

12. A process according to claim 11, in which the ratio of basifier to lactone is 1:1.

13. A process according to claim 1, in which the substrate comprises natural or synthetic polyamides, basic modified polyamides, acid dyeable polyesters, cellulose-2½- acetate, cellulose triacetate, polypropylene, polyacrylonitrile and basic modified polyacrylonitrile or blends thereof.

14. A process according to claim 13, in which the substrate is a differential polyamide.

15. A process according to claim 14, in which the substrate is in fibre, fabric or yarn form.

16. A process according to claim 1, in which the amount of lactone added to the dyeing or printing medium is sufficient to adjust the pH value to a value from 5 to 6.

17. A process according to claim 1 wherein dyeing is carried out for a short time in a basic dye liquor and the lactone is added subsequently to exhaust the dye liquor.

18. A process according to claim 1 wherein a basifier is added, dyeing is carried out for a short time in a basic dye liquor and the lactone is added subsequently to exhaust the dye liquor.

* * * * *